US010490339B2

(12) United States Patent
Maeda

(10) Patent No.: US 10,490,339 B2
(45) Date of Patent: Nov. 26, 2019

(54) REACTOR INCLUDING FIRST END PLATE AND SECOND END PLATE

(71) Applicant: FANUC CORPORATION, Yamanashi (JP)

(72) Inventor: Takuya Maeda, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 197 days.

(21) Appl. No.: 15/667,982

(22) Filed: Aug. 3, 2017

(65) Prior Publication Data

US 2018/0068783 A1 Mar. 8, 2018

(30) Foreign Application Priority Data

Sep. 8, 2016 (JP) ..... 2016-175820

(51) Int. Cl.

| | |
|---|---|
| ***H01F 27/24*** | (2006.01) |
| ***H01F 27/34*** | (2006.01) |
| ***H01F 27/04*** | (2006.01) |
| ***H01F 27/26*** | (2006.01) |
| ***H01F 3/14*** | (2006.01) |
| ***H01F 27/28*** | (2006.01) |

(52) U.S. Cl.

CPC ..... *H01F 27/346* (2013.01); *H01F 3/14* (2013.01); *H01F 27/04* (2013.01); *H01F 27/24* (2013.01); *H01F 27/263* (2013.01); *H01F 27/266* (2013.01); *H01F 27/28* (2013.01); *H01F 27/2876* (2013.01)

(58) Field of Classification Search

CPC ..... H01F 27/00–36

USPC .... 336/65, 83, 170–173, 212–215, 220–223, 336/233–234

See application file for complete search history.

(56) References Cited

U.S. PATENT DOCUMENTS

| | | | | |
|---|---|---|---|---|
| 2,406,704 A * | 8/1946 | Mossay | H01F 30/12 | 307/156 |
| 2,442,751 A * | 6/1948 | Abbott | H01F 29/10 | 336/135 |
| 2015/0123479 A1* | 5/2015 | Kurita | H01F 37/00 | 307/66 |
| 2016/0125998 A1* | 5/2016 | Bhide | H01F 37/00 | 336/5 |

FOREIGN PATENT DOCUMENTS

| | | |
|---|---|---|
| JP | 57128009 A | 8/1982 |
| JP | 61224307 A | 10/1986 |
| JP | 974023 A | 3/1997 |

(Continued)

OTHER PUBLICATIONS

Untranslated Notification of Reasons for Refusal issued by Japan Patent Office (JPO) in related Japanese Application No. 2016-175820, dated Jul. 17, 2018, 4 pgs.

(Continued)

*Primary Examiner* — Tuyen T Nguyen

(74) *Attorney, Agent, or Firm* — Fredrikson & Byron, P.A.

(57) ABSTRACT

A reactor includes a core body; a first end plate and a second end plate which sandwich and fasten the core body; and an axis portion which passes through the center of the core body and is supported by the first end plate and the second end plate. The center of the core body includes a region at which a magnetic field is not formed.

7 Claims, 8 Drawing Sheets

(56) References Cited

FOREIGN PATENT DOCUMENTS

| | | | |
|---|---|---|---|
| JP | 200077242 | A | 3/2000 |
| JP | 2008210998 | A | 9/2008 |
| WO | 2014073238 | A1 | 5/2014 |

OTHER PUBLICATIONS

English Machine Translation of Notification of Reasons for Refusal issued by Japan Patent Office (JPO) dated Jul. 17, 2018 in related Japanese Application No. 2016-175820, 3 pgs.
Untranslated Decision to Grant a Patent issued by Japan Patent Office (JPO) dated Dec. 11, 2018 in related Japanese Application No. 2016-175820, 3 pgs.
English Machine Translation of Decision to Grant a Patent issued by Japan Patent Office (JPO) dated Dec. 11, 2018 in related Japanese Application No. 2016-175820, 3 pgs.
English Abstract and Machine Translation for Japanese Publication No. 2000-077242 A, published Mar. 14, 2000, 20 pgs.
English Abstract and Machine Translation for Japanese Publication No. 2008-210998 A, published Sep. 11, 2008, 11 pgs.
English Abstract and Machine Translation for International Publication No. WO 2014/073238 A1, published May 15, 2014, 31 pgs.
English Abstract and Machine Translation for Japanese Publication No. JPH09-74023 A, published Mar. 18, 1997, 9 pgs.
English Abstract and Machine Translation for Japanese Publication No. JPS61-224307 published Oct. 6, 1986, 5 pgs.
English Abstract and Machine Translation for Japanese Publication No. JPS57-128009 A, published Aug. 9, 1982, 3 pgs.

* cited by examiner

REACTOR INCLUDING FIRST END PLATE AND SECOND END PLATE

BACKGROUND OF THE INVENTION

1. Field of the Invention

The present invention relates to a reactor. In particular, the present invention relates to a reactor in which a core body is held between a first end plate and a second end plate.

2. Description of the Related Art

FIG. 6 is a perspective view of a reactor according to a conventional technique as disclosed in Japanese Unexamined Patent Publication (Kokai) No. 2000-77242 and Japanese Unexamined Patent Publication (Kokai) No. 2008-210998. As illustrated in FIG. 6, a reactor 100 includes a substantially E-shaped first iron core 150 including two first outer side leg portions 151, 152 and a first center leg portion 153 disposed between the first outer side leg portions 151, 152 and a substantially E-shaped second iron core 160 including two second outer side leg portions 161 and 162 and a second center leg portion 163 disposed between the second outer side leg portions 161 and 162. The first iron core 150 and the second iron core 160 are formed by stacking a plurality of electrical steel plates. Note that in FIG. 6, a stacking direction of the electrical steel plates is indicated by an arrow.

Further, a coil 171 is wound onto the first outer side leg portion 151 and the second outer side leg portion 161. Similarly, a coil 172 is wound onto the first outer side leg portion 152 and the second outer side leg portion 162, and a coil 173 is wound onto the first center leg portion 153 and the second center leg portion 163.

FIG. 7 is a diagram illustrating the first iron core and the second iron core of the reactor illustrated in FIG. 6. In FIG. 7, for the sake of clarity, illustration of the coils is omitted. As illustrated in FIG. 7, the two first outer side leg portions 151 and 152 of the first iron core 150 respectively face the two second outer side leg portions 161 and 162 of the second iron core 160. Further, the first center leg portion 153 and the second center leg portion 163 face each other. Then, between the leg portions, a gap G is formed.

SUMMARY OF INVENTION

To form the reactor 100, the first iron core 150 and the second iron core 160 are coupled to each other. In addition, because the first iron core 150 and the second iron core 160 are formed by stacking a plurality of electrical steel plates, noises and vibrations may be generated while the reactor drives. In view of such a point as well, the first iron core 150 and the second iron core 160 are desirably coupled to each other.

However, since the gap G is to be formed, the first iron core 150 and the second iron core 160 cannot be directly coupled to each other. Accordingly, the first iron core 150 and the second iron core 160 are coupled to each other while the gap G is maintained.

FIG. 8 is an enlarged side view of the gap. In FIG. 8, to configure the reactor 100, the outer side leg portions 151 and 161 are coupled to each other by coupling plates 181 and 182. It is assumed that similarly, the other leg portions are configured as well. However, in such a case, a configuration of the reactor 100 is complicated. As a result, it is difficult to control a gap length which influences the inductance. In addition, when the coupling plates 181 and 182 are made of a magnetic material, leakage of magnetic flux occurs, which is unfavorable.

The present invention has been made in view of such circumstances and has an object to provide a reactor which can be suitably supported while leakage of magnetic flux fails to occur.

To achieve the above object, according to the first invention, there is provided a reactor including: a core body; a first end plate and a second end plate which sandwich and fasten the core body; and an axis portion which passes through a center of the core body and is supported by the first end plate and the second end plate.

Such objects, features, and advantages and other objects, features, and advantages of the present invention will be further clearer from the detailed description of typical embodiments of the present invention which are illustrated in the attached drawings.

DETAILED DESCRIPTION

Hereinafter, embodiments of the present invention will be described with reference to the attached drawings. In the following figures, similar members are assigned similar reference signs. To facilitate understanding, these figures are suitably changed in scale.

In the following description, a three-phase reactor will be described by way of example, while application of the present invention is not limited to the three-phase reactor but application can be widely made to a multiphase reactor in each phase of which constant inductance is to be provided. In addition, the reactor of the present invention is not limited to that as provided on the primary side and the secondary side of an inverter in an industrial robot or a machine tool, but can be applied to various devices.

Figure 1:
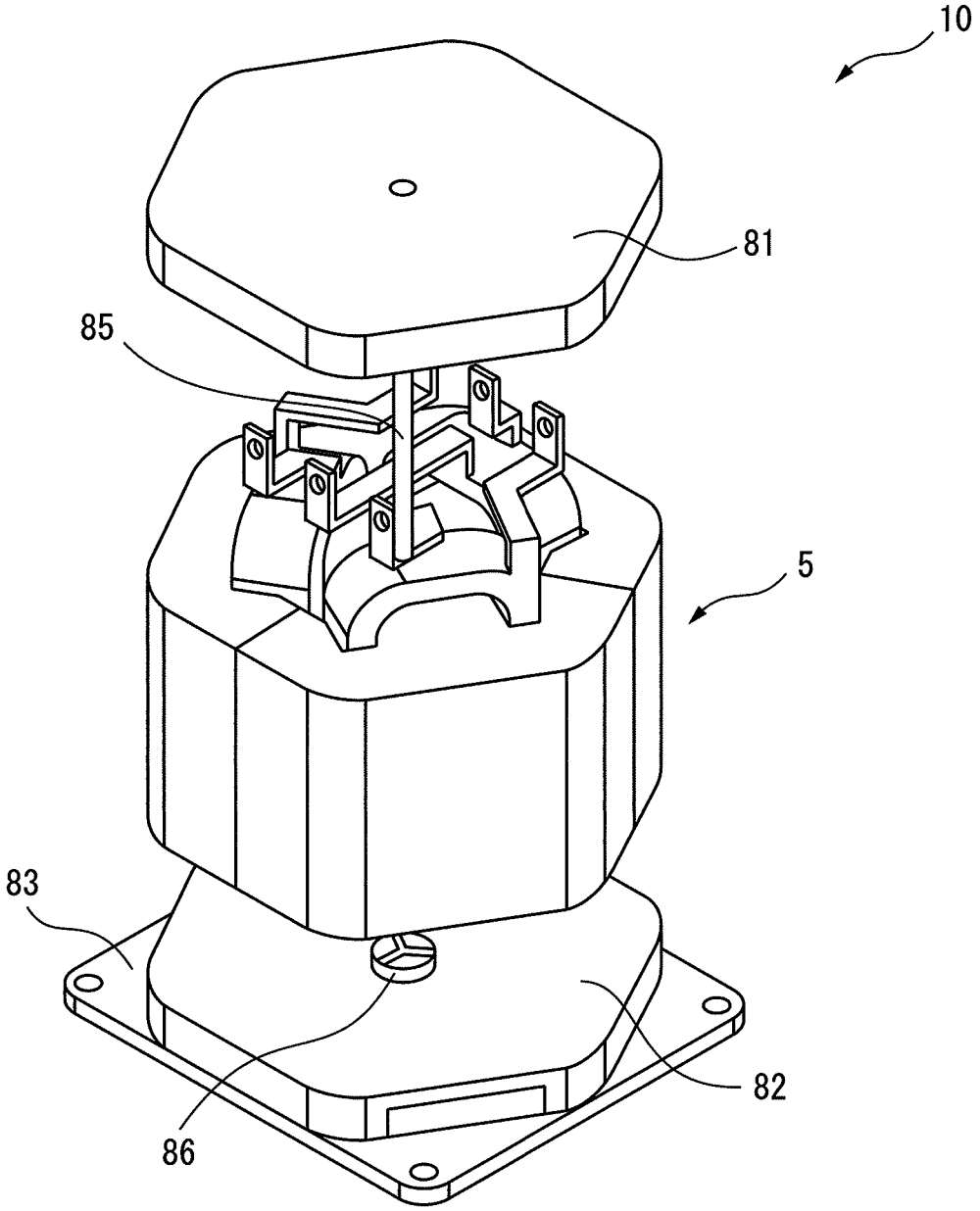
FIG. 1 is an exploded perspective view of a reactor according to the present invention.
Figure 2:
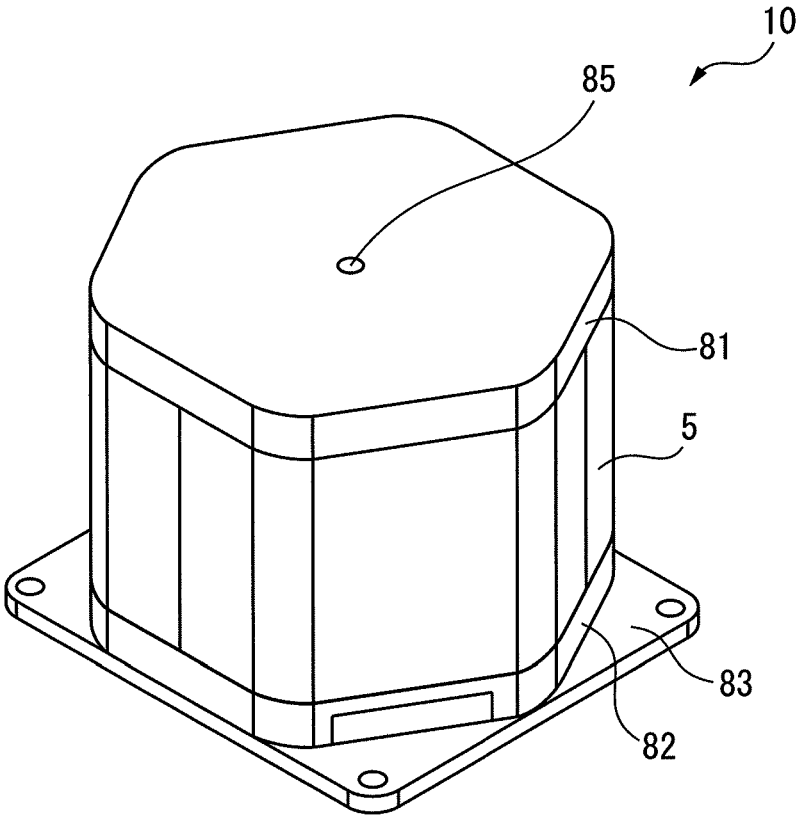
FIG. 2 is a perspective view of the reactor illustrated in FIG. 1.

FIG. 1 is an exploded perspective view of a reactor according to the present invention, and FIG. 2 is a perspective view of the reactor illustrated in FIG. 1. A reactor 10 illustrated in FIGS. 1 and 2 mainly includes a core body 5 and a first end plate 81 and a second end plate 82 which sandwich and fasten the core body 5 in an axial direction. The first end plate 81 and the second end plate 82 are in contact with an outer circumference portion iron core 20 over the entire edge portion of the outer circumference portion iron core 20 of the core body 5 as described below.

As illustrated in FIG. 1, the second end plate 82 includes a flange 83. The flange 83 is provided with a plurality of holes which are used to mount the reactor 10 to another member. The first end plate 81 and the second end plate 82 are preferably made of a non-magnetic material, such as aluminum, SUS, or a resin.

Figure 3:
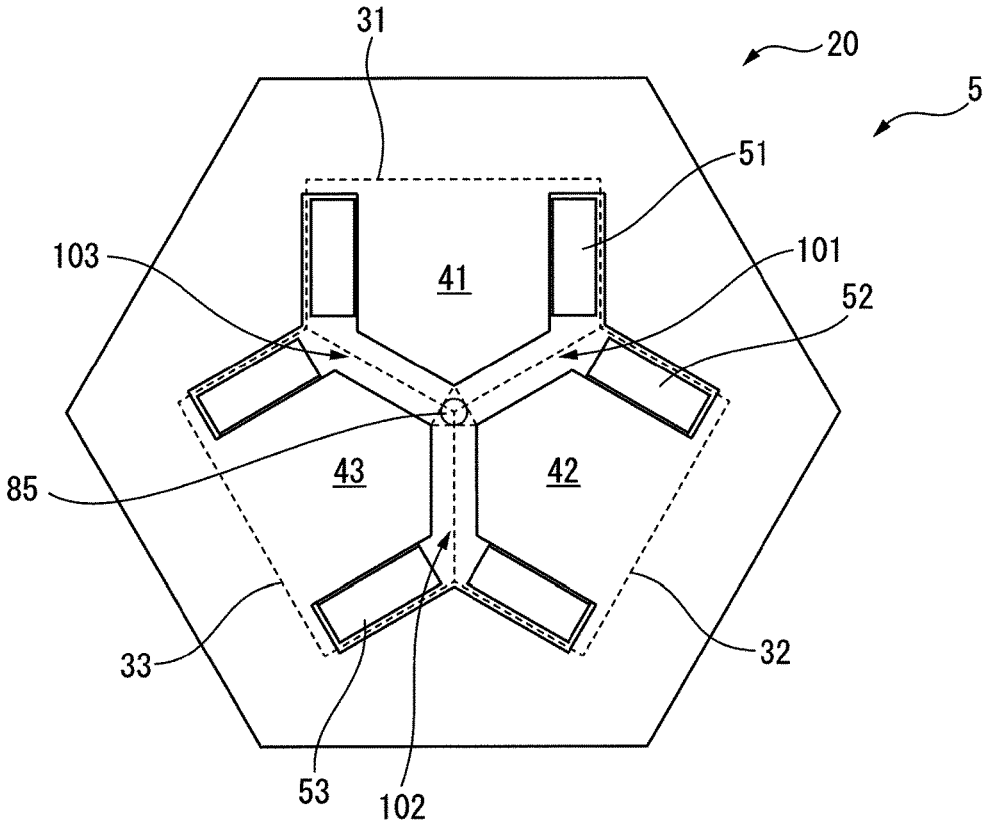
FIG. 3 is a cross-sectional view of a core body.

FIG. 3 is a cross-sectional view of the core body. As illustrated in FIG. 3, the core body 5 includes the outer circumference portion iron core 20 and three iron core coils 31-33 which are magnetically coupled to the outer circumference portion iron core 20 in a mutual manner. In FIG. 3, the iron core coils 31-33 are disposed inside the outer circumference portion iron core 20 having a substantially hexagonal shape. The iron core coils 31-33 are disposed at equal intervals in a circumferential direction of the core body 5.

Note that the outer circumference portion iron core 20 may have another rotationally symmetrical shape, such as a circular shape. It is assumed in such a case that the first end plate 81 and the second end plate 82 have a shape corresponding to that of the outer circumference portion iron core 20. In addition, a number of iron core coils only needs to be a multiple of three.

As apparent from the figure, the iron core coils 31-33 respectively include iron cores 41-43 which extend in a radial direction of the outer circumference portion iron core 20 and coils 51-53 which are wound onto the respective iron cores. A radial direction outer side end portion of each of the iron cores 41-43 is in contact with the outer circumference portion iron core 20 or formed integrally with the outer circumference portion iron core 20.

Further, a radial direction inner side end portion of each of the iron cores 41-43 is positioned in the vicinity of the center of the outer circumference portion iron core 20. In the figure, the radial direction inner side end portion of each of the iron cores 41-43 converges toward the center of the outer circumference portion iron core 20, and a tip end angle thereof is approximately 120°. Then, the radial direction inner side end portions of the iron cores 41-43 are separated from each other with gaps 101-103 therebetween which can be magnetically coupled.

In other words, the radial direction inner side end portion of the iron core 41 is separated from the radial direction inner side end portion of each of the adjacent two iron cores 42, 43 with the gaps 101, 103 therebetween, respectively. Similarly, the other iron cores 42, 43 are configured as well. Note that it is assumed that sizes of the gaps 101-103 are equal to each other.

Thus, in the present invention, a center portion iron core positioned at a center portion of the core body 5 is unnecessary, so that the core body 5 can be configured to be light and simple. Further, the three iron core coils 31-33 are enclosed by the outer circumference portion iron core 20, so that a magnetic field generated from the coils 51-53 fails to leak out of the outer circumference portion iron core 20. In addition, the gaps 101-103 can be provided to have any thickness with low costs, which is thus advantageous in terms of design as compared with reactors having a conventional configuration.

Further, in the core body 5 of the present invention, a difference in magnetic path length among phases is small as compared with reactors having a conventional configuration. Thus, in the present invention, unbalance of the inductance due to a difference in magnetic path length can be reduced as well.

Figure 4A:
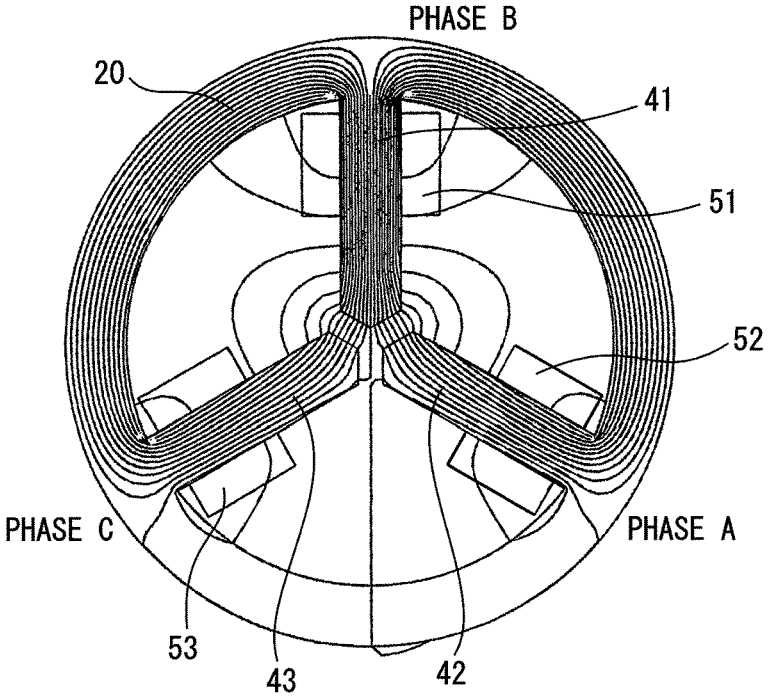
FIG. 4A is a first diagram illustrating a magnetic field of the core body having a shape similar to that illustrated in FIG. 3.

Incidentally, FIGS. 4A-4D are diagrams illustrating a magnetic field of the core body having a shape similar to that as illustrated in FIG. 3. In the core body illustrated in FIG. 4A, sizes of the iron cores and the coils differ from sizes of the iron cores and the coils illustrated in FIG. 3. In addition, FIG. 4A illustrates a case in which an electrical angle is 60°. As illustrated in FIG. 4A, a region without a magnetic field at the center of the core body 5, i.e., a bending point of the three phases is present.

Figure 4B:
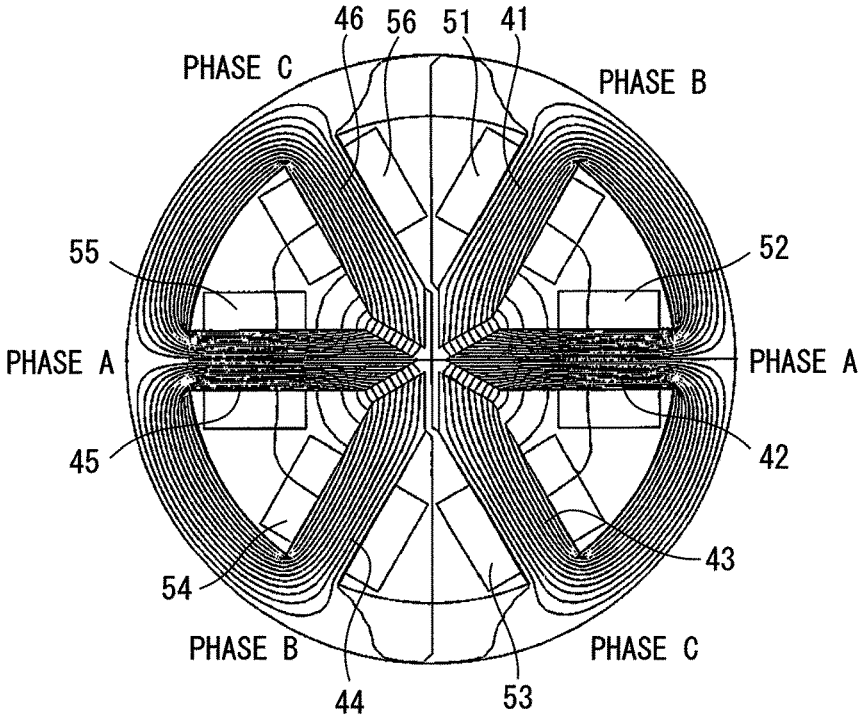
FIG. 4B is a second diagram illustrating a magnetic field of the core body having a shape similar to that illustrated in FIG. 3.
Figure 4C:
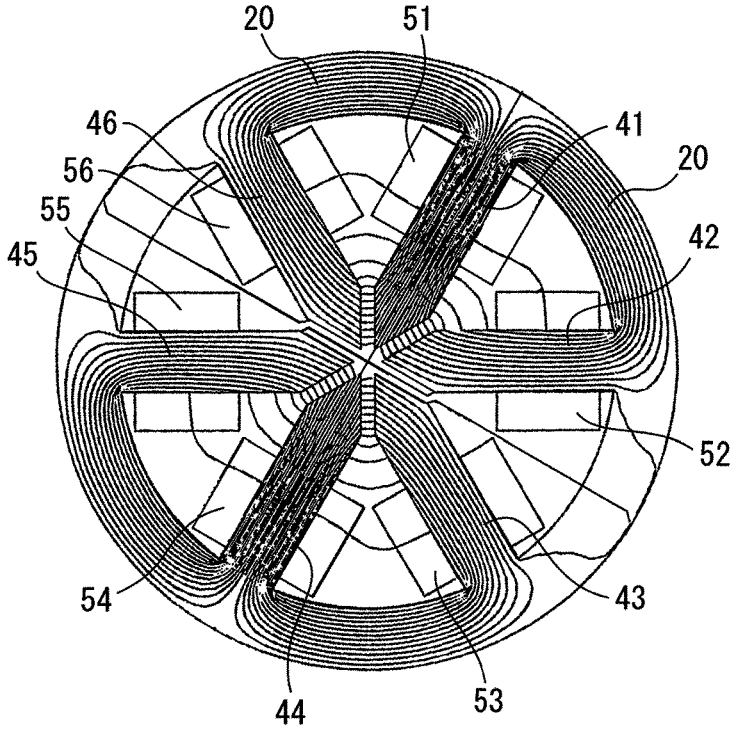
FIG. 4C is a third diagram illustrating a magnetic field of the core body having a shape similar to that illustrated in FIG. 3.
Figure 4D:
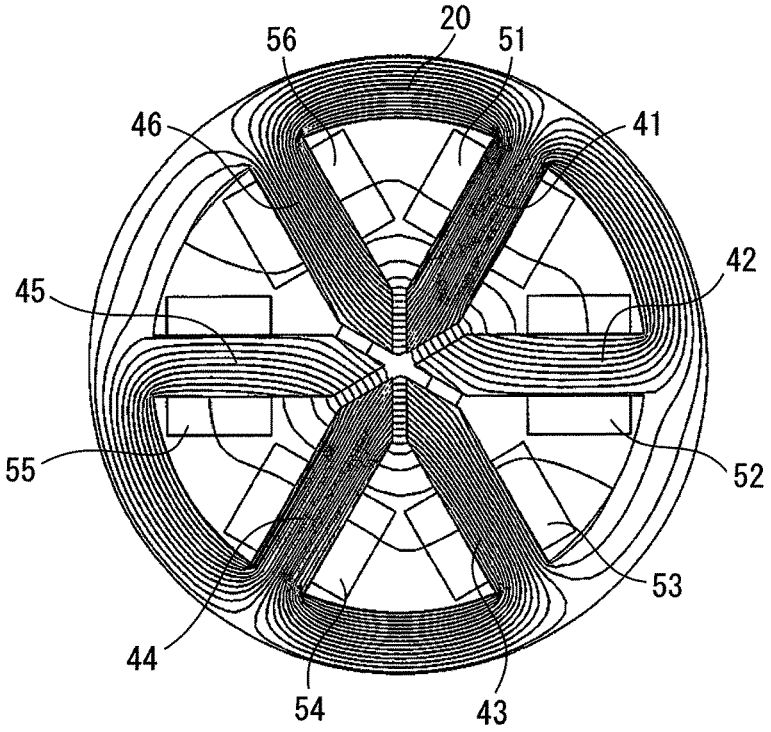
FIG. 4D is a fourth diagram illustrating a magnetic field of the core body having a shape similar to that illustrated in FIG. 3.

Further, the core body 5 in FIGS. 4B-4D includes six iron cores 41-46 disposed at equal intervals in the circumferential direction and six coils 51-56 wound onto the iron cores 41-46. Then, cases in which electrical angles in FIGS. 4B to 4D are 0°, 60°, and 250°, respectively, are illustrated. In the core body 5 illustrated in FIGS. 4B-4D as well, a region without a magnetic field at the center thereof is present.

In an example illustrated in FIG. 3, the three iron cores 41-43 having the same size with respect to each other, which include the radial direction inner side end portion having an angle of approximately 120°, are illustrated. In such a case, the region without a magnetic field, i.e., the bending point of the three phases corresponds to an equilateral triangle shaped by connecting the vertexes of the iron cores 41-43. Note that in embodiments as illustrated in FIGS. 4B to 4D, the region without a magnetic field corresponds to a regular hexagon shaped by connecting the vertexes of the six iron cores.

In other words, the center of the core body 5 illustrated in FIG. 3 and others is the region without a magnetic field, so that even if another member made of a non-magnetic material or a magnetic material is disposed, a magnetic field in the core body 5 is not influenced. Thus, preferably, at the center of the core body 5, a member, which supports the core body 5, is disposed. However, the region without a magnetic field as described above has a limited size, and in a case of the magnetic material, in the support member as described above, such a size as not to be influenced by a magnetic field is limited. If the non-magnetic material is used, an influence of a magnetic field can be reduced and the support member can be enlarged, and thus in view of practicality and design, using the non-magnetic material facilitates firm support of the core body and is preferable.

Referring to FIG. 1 again, from the center of an inner surface of the first end plate 81, an axis portion 85 extends downward. The axis portion 85 may be screwed into a through hole provided at the center of the first end plate 81 from an outer surface side of the first end plate 81. The axis portion 85 is preferably made of a non-magnetic material, such as aluminum, SUS, or a resin. Further, a length of the axis portion 85 is preferably greater than a length of the core body 5 in the axial direction. In addition, at the center of an inner surface of the second end plate 82, a recessed portion 86 which houses a tip end of the axis portion 85 is provided.

Accordingly, when the reactor 10 is assembled as illustrated in FIG. 2, the axis portion 85 is positioned at a region on a center line of the reactor 10 illustrated in FIG. 3. The core body 5 is firmly held through the axis portion 85 between the first end plate 81 and the second end plate 82. Consequently, even while the reactor 10 drives, generation of noises and vibrations can be restrained. Note that the tip end of the axis portion 85 and the second end plate 82 may be coupled by a screw, and it will be apparent that in such a case, noises and vibrations can be further restrained.

As described above, at the region at which the axis portion 85 is disposed, a magnetic field fails to be generated, and the axis portion 85 is made of a non-magnetic material. Thus, a magnetic field is not influenced by the axis portion 85. Further, in the present invention, the coupling plates as described in the prior art are not to be used, which consequently enables easy control of a gap length.

In addition, the axis portion 85 may be solid or hollow. When the axis portion 85 is solid, the core body 5 can be firmly held. Further, it will be apparent that when the axis portion 85 is hollow, the entire reactor 10 can be configured to be light.

Figure 5A:
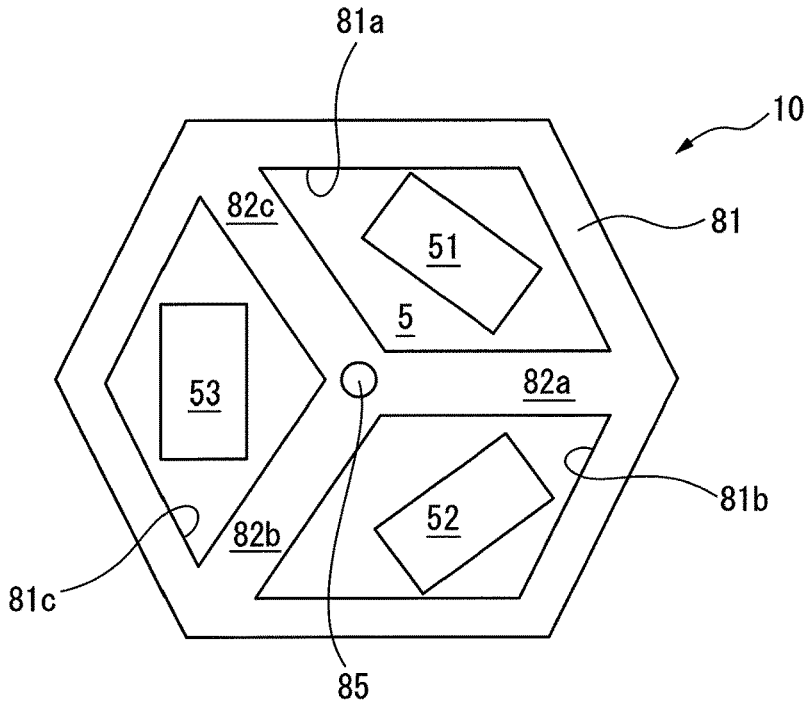
FIG. 5A is a top view of another reactor.

Further, FIG. 5A is a top view of another reactor. In an embodiment illustrated in FIG. 5A, the first end plate 81 includes a plurality of extension portions 82*a*-82*c* which extend toward the center thereof. Then, between the extension portions 82*a*-82*c* adjacent to each other, through holes 81*a*-81*c* are provided. Then, the plurality of coils 51-53 are respectively positioned in regions of the through holes 81*a*-81*c*. Note that the axis portion 85 is positioned at the intersection of the plurality of extension portions 82*a*-82*c*.

Figure 5B:
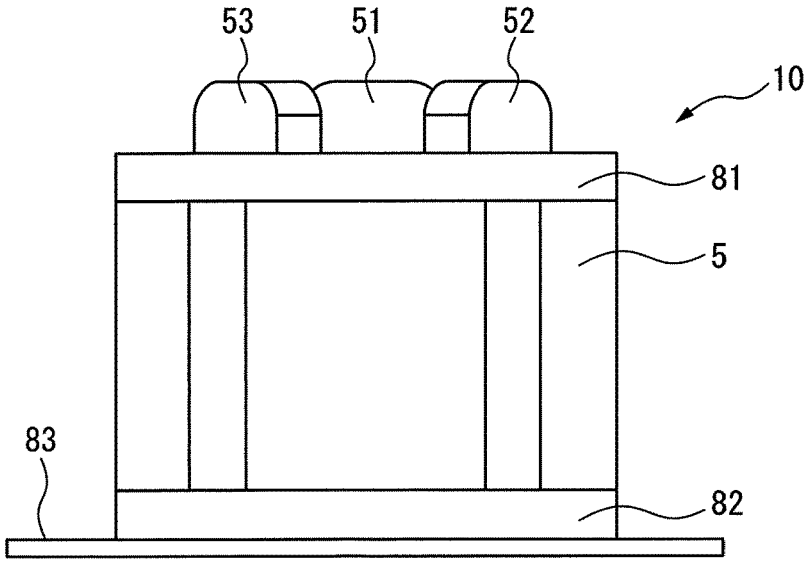
FIG. 5B is a side view of the reactor illustrated in FIG. 5A.
Figure 6:
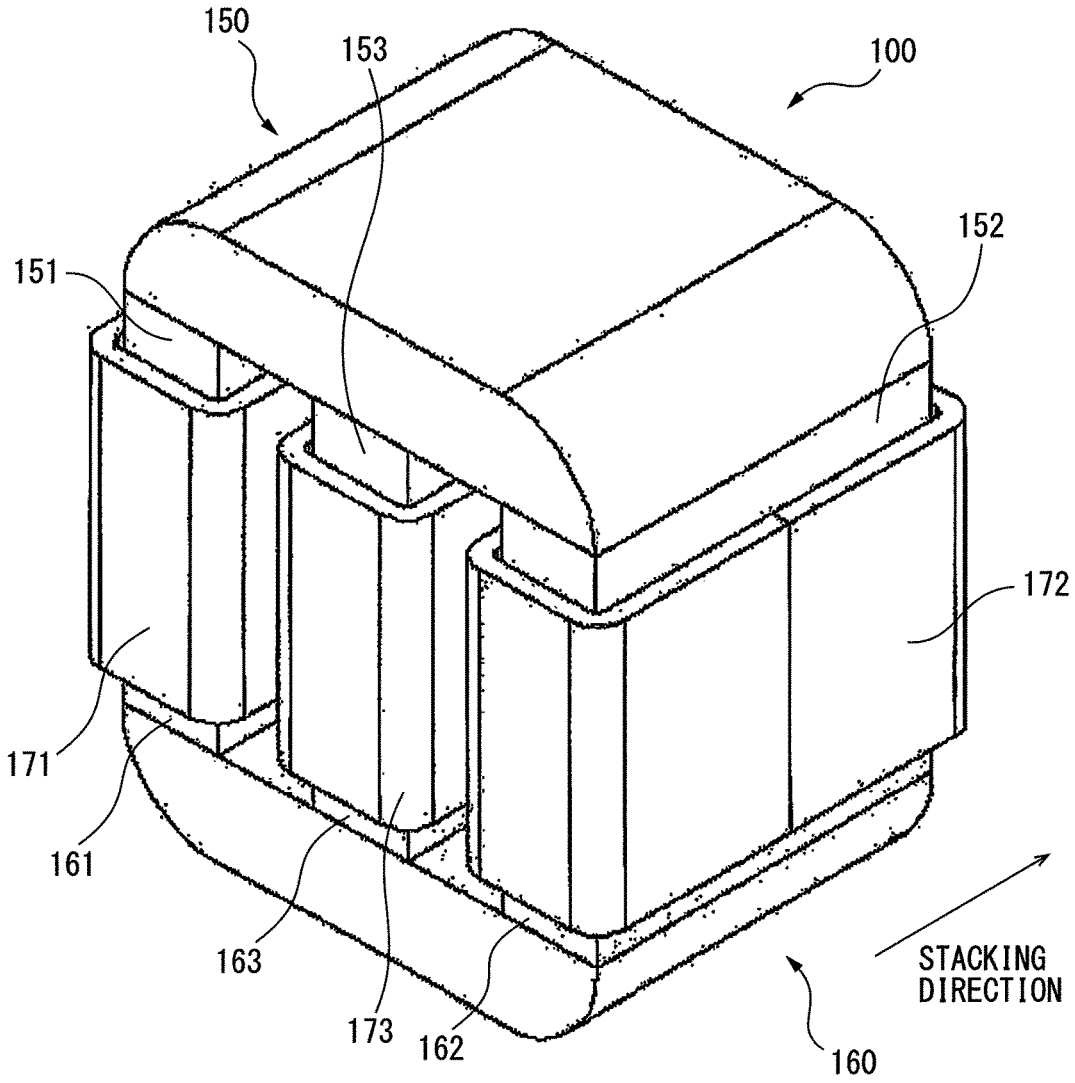
FIG. 6 is a perspective view of a reactor according to a conventional technique.
Figure 7:
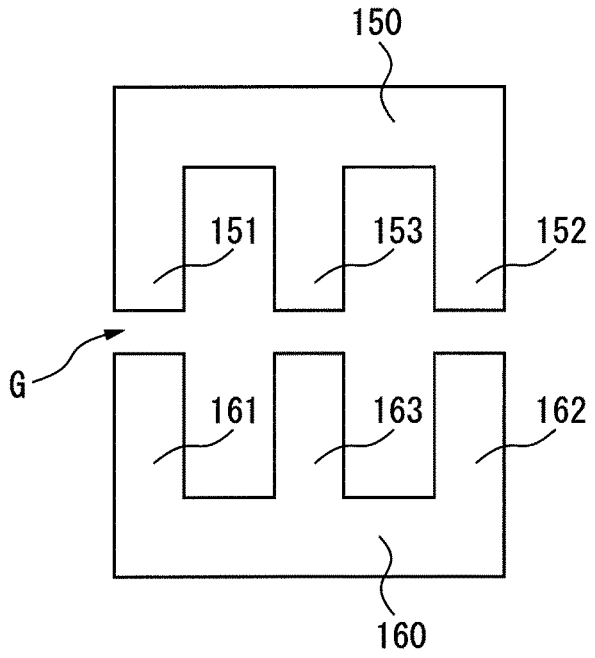
FIG. 7 is a diagram illustrating a first iron core and a second iron core of the reactor illustrated in FIG. 6.
Figure 8:
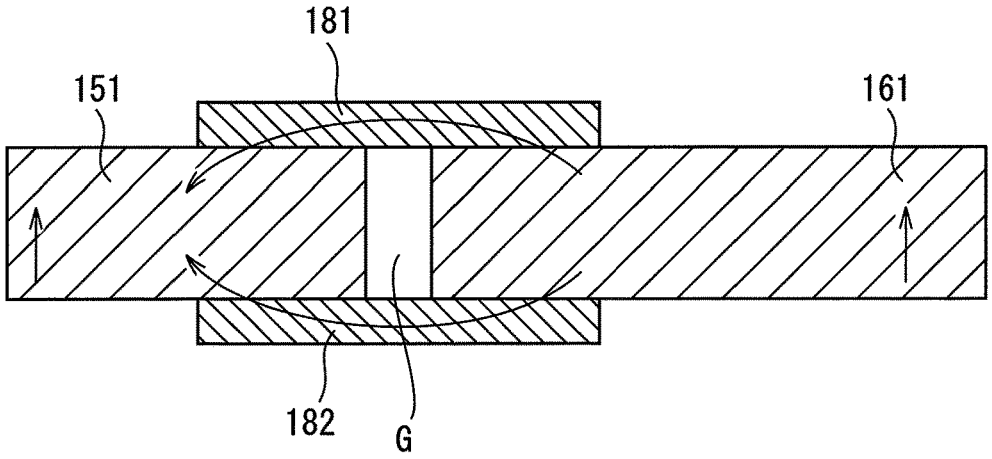
FIG. 8 is an enlarged side view of a gap.

Still further, FIG. 5B is a side view of the reactor illustrated in FIG. 5A. As apparent from FIG. 5A and FIG. 5B, when the reactor 10 is assembled, the coils 51-53 partially pass through the respective through holes 81*a*-81*c* and protrude from the outer surface of the first end plate 81. It will be apparent that in such a case, heat generated from the coils 51-53 can be air-cooled while the reactor 10 drives. Note that it may be also configured that the second end plate 82 is provided with similar through holes and the coils partially protrude from an outer surface of the second end plate 82.

Note that a configuration of the core body 5 is not limited to those illustrated by the figures, and even the core body 5 having another configuration in which a plurality of iron core coils are enclosed by the outer circumference portion iron core 20 and a region without a magnetic field is provided at the center is within the scope of the present invention.

Aspects of the Disclosure

According to a first aspect, there is provided a reactor including a core body; a first end plate and a second end plate which sandwich and fasten the core body; and an axis portion which passes through a center of the core body and is supported by the first end plate and the second end plate.

According to a second aspect, in the first aspect, the core body includes: an outer circumference portion iron core; at least three iron cores which are in contact with an inner surface of the outer circumference portion iron core or coupled to the inner surface; and coils respectively wound onto the at least three iron cores, a gap which can be magnetically coupled is formed between two iron cores adjacent to each other from among the at least three iron cores, and a region at which a magnetic field fails to be formed is formed at the center of the core body.

According to a third aspect, in the first or second aspect, the axis portion is solid.

According to a fourth aspect, in the first or second aspect, the axis portion is hollow.

According to a fifth aspect, in any one of the first to fourth aspects, at least one of the first end plate and the second end plate is provided with a through hole, and the coils pass through the through hole of the at least one of the first end plate and the second end plate and protrude further outward than the at least one of the first end plate and the second end plate.

According to a sixth aspect, in any one of the first to fifth aspects, the axis portion is made of a non-magnetic material.

According to a seventh aspect, in any one of the first to sixth aspects, the first end plate and the second end plate are made of a non-magnetic material.

According to an eighth aspect, in any one of the first to seventh aspects, the first end plate and the second end plate are in contact with the outer circumference portion iron core over an entire edge portion of the outer circumference portion iron core.

Effects of the Aspects

In the first and second aspects, the axis portion passes through the center of the core body, so that the reactor can be suitably supported. Further, at the position of the axis portion, a magnetic field is not formed so that an influence on a magnetic field by the axis portion can be avoided. In addition, the coils are enclosed by the outer circumference portion iron core, so that occurrence of leakage of magnetic flux can be avoided. Further, it is not necessary to use a coupling plate, thus it is possible to easily control a gap length.

In the third aspect, the core body can be firmly supported.

In the fourth aspect, the entire reactor can be configured to be light.

In the fifth aspect, the coils protrude further outward than at least one of the first end plate and the second end plate, so that coil cooling effects can be enhanced.

In the sixth and seventh aspects, the magnetic material which composes the axis portion, the first end plate, and the second end plate is preferably, for example, aluminum, SUS, a resin, or the like, thereby preventing a magnetic field from passing the axis portion, the first end plate, and the second end plate.

In the eighth aspect, the core body can be firmly held.

Typical embodiments have been used to describe the present invention, but a person skilled in the art would understand that the above-mentioned changes and various other changes, deletions, and additions can be made without departing from the scope of the present invention.

The invention claimed is:

1. A reactor comprising:

a core body;

a first end plate and a second end plate which sandwich and fasten the core body; and an axis portion which passes through a center of the core body and is supported by the first end plate and the second end plate;

wherein the core body includes:

an outer circumference portion iron core;

at least three iron cores which are in contact with an inner surface of the outer circumference portion iron core or coupled to the inner surface; and coils respectively wound onto the at least three iron cores, the at least three iron cores extend only in a radial direction of the outer circumference portion iron core, between two iron cores adjacent to each other from among the at least three iron cores, a gap which can be magnetically coupled is formed, and a region at which a magnetic field fails to be formed is formed at the center of the core body.

2. The reactor according to claim 1, wherein the axis portion is solid.

3. The reactor according to claim 1, wherein the axis portion is hollow.

4. The reactor according to claim 1, wherein at least one of the first end plate and the second end plate is provided with a through holes, and the coils pass through the through holes of the at least one of the first end plate and the second end plate and protrude further outward than the at least one of the first end plate and the second end plate.

5. The reactor according to claim 1, wherein the axis portion is made of a non-magnetic material.

6. The reactor according to claim 1, wherein the first end plate and the second end plate are made of a non-magnetic material.

7. The reactor according to claim 1, wherein the first end plate and the second end plate are in contact with the outer circumference portion iron core over an entire edge portion of the outer circumference portion iron core.

* * * * *